US009256200B2

(12) United States Patent
Fujita et al.

(10) Patent No.: US 9,256,200 B2
(45) Date of Patent: Feb. 9, 2016

(54) IMAGE FORMING APPARATUS

(71) Applicant: CANON KABUSHIKI KAISHA, Tokyo (JP)

(72) Inventors: Keiko Fujita, Kashiwa (JP); Hideki Mori, Toride (JP); Hiroshi Saito, Toride (JP); Hitoshi Kubota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/288,560

(22) Filed: May 28, 2014

(65) Prior Publication Data

US 2014/0376949 A1 Dec. 25, 2014

(30) Foreign Application Priority Data

Jun. 25, 2013 (JP) ..... 2013-132634

(51) Int. Cl.

| | |
|---|---|
| ***G03G 21/20*** | (2006.01) |
| *G03G 15/00* | (2006.01) |
| *G03G 15/02* | (2006.01) |
| *G03G 15/20* | (2006.01) |
| *G03G 15/23* | (2006.01) |

(52) U.S. Cl.

CPC ..... *G03G 21/206* (2013.01); *G03G 15/2017* (2013.01); *G03G 15/0258* (2013.01); *G03G 15/2003* (2013.01); *G03G 15/234* (2013.01); *G03G 15/6529* (2013.01); *G03G 15/6573* (2013.01); *G03G 21/20* (2013.01); *G03G 2215/00679* (2013.01); *G03G 2221/1645* (2013.01)

(58) Field of Classification Search

USPC ..... 399/92

See application file for complete search history.

(56) References Cited

U.S. PATENT DOCUMENTS

| | | | | |
|---|---|---|---|---|
| 5,335,049 | A * | 8/1994 | Kanai et al. | 399/92 |
| 6,272,311 | B1 * | 8/2001 | Baughman et al. | 399/341 |
| 7,322,881 | B2 * | 1/2008 | Ishii | 454/155 |
| 2006/0072933 | A1 * | 4/2006 | Miyamoto et al. | 399/92 |
| 2006/0275048 | A1 * | 12/2006 | Nishimura et al. | 399/92 |
| 2008/0219693 | A1 * | 9/2008 | Kondo et al. | 399/92 |
| 2010/0034553 | A1 * | 2/2010 | Kawamata | 399/92 |
| 2012/0308279 | A1 | 12/2012 | Tanaka et al. | |
| 2014/0035223 | A1 * | 2/2014 | Kato | 271/225 |
| 2014/0376949 | A1 * | 12/2014 | Fujita et al. | 399/92 |

FOREIGN PATENT DOCUMENTS

| | | | | |
|---|---|---|---|---|
| JP | 2001-063890 | * | 3/2001 | G03G 15/00 |
| JP | 2005-070459 | * | 3/2005 | G03G 21/20 |
| JP | 2005-70459 A | | 3/2005 | |
| JP | 2008-299281 | * | 12/2008 | G03G 21/20 |
| JP | 2008-299281 A | | 12/2008 | |

* cited by examiner

*Primary Examiner* — Clayton E Laballe
*Assistant Examiner* — Kevin Butler
(74) *Attorney, Agent, or Firm* — Fitzpatrick, Cella, Harper & Scinto

(57) ABSTRACT

An image forming apparatus includes a fixing unit heating an image formed on a recording medium and disposed along a conveying path conveying the recording medium. The conveying path includes a first guide plate, discharge guide plate portions and second guide plate portion as conveyance guide plates guiding the recording medium. Partition walls and vertical walls are disposed at positions facing these guide plate portions. The air current guide portion guides air taken in from intake ports through an intake guide portion between the respective guide plate portions and each walls.

7 Claims, 5 Drawing Sheets

IMAGE FORMING APPARATUS

BACKGROUND OF THE INVENTION

1. Field of the Invention

The present invention relates to an image forming apparatus configured to be able to form an image on a recording medium such as a copier, a printer, a facsimile, and a multi-function printer.

2. Description of the Related Art

Heretofore, there is disclosed an image forming apparatus configured such that an exhaust port exhausting exhaust heat of the image forming apparatus is provided within an intra-body sheet discharge portion as disclosed in Japanese Patent Application Laid-open No. 2005-70459. This configuration improves usability of the apparatus because it permits to reduce influences of heat and sound otherwise generated from an exhaust port provided near a side surface of the apparatus. This configuration also improves installability of the apparatus because it permits to reduce an installation space by allowing a side surface of the apparatus to be placed closely to a wall of a room.

However, because the image forming apparatus of JPA No. 2005-70459 described above is configured such that the exhaust port is mounted in the intra-sheet discharge portion and the exhaust heat within the apparatus is merely exhausted through this exhaust port, there is a possibility that it is hard to assure an enough required air quantity for each heat generating source depending on disposition of the heat generating sources and on configuration of air channels for exhausting the heat. It is conceivable to separate an air channel from each heat generating source to the exhaust port by ducts for instance in order to avoid such possibility. However, costs and size of the apparatus increase if new ducts are added.

Meanwhile, what is influential as a heat generating source of the image forming apparatus is a fixing unit, i.e., an image heating portion, heating an image formed on a recording medium. The fixing unit is disposed along a conveying path through which the recording medium is conveyed. The recording medium passing through the fixing unit also becomes a heat generating source because it is heated by the fixing unit.

SUMMARY OF THE INVENTION

According to an aspect of the present invention, an image forming apparatus includes an image forming portion configured to form an image on a recording medium, a conveyance guide forming a part of a conveying path conveying the recording medium and including a plurality of ribs guiding the recording medium, a wall member disposed to face the conveyance guide and forming a part of the conveying path, a heating unit disposed along the conveying path and heating the image formed on the recording medium, an intake port disposed below the heating unit and taking outside air into the image forming apparatus, an exhaust port disposed above the heating unit and exhausting the air out of the image forming apparatus, an air current guide portion formed by the conveyance guide and the wall member and guiding the air flown into the image forming apparatus through the intake port to the exhaust port, and an air current generating unit generating an air current within the air current guide portion, wherein the air current guide portion is configured such that the closer to an upstream side in a guide direction thereof, the greater airflow resistance of the air current becomes.

Further features of the present invention will become apparent from the following description of exemplary embodiments with reference to the attached drawings.

DESCRIPTION OF THE EMBODIMENTS

An embodiment of the present invention will be described with reference to FIGS. 1 through 5. Firstly, a configuration of an image forming apparatus of the present embodiment will be schematically described with reference to FIG. 1.

[Image Forming Apparatus]

Figure 1:
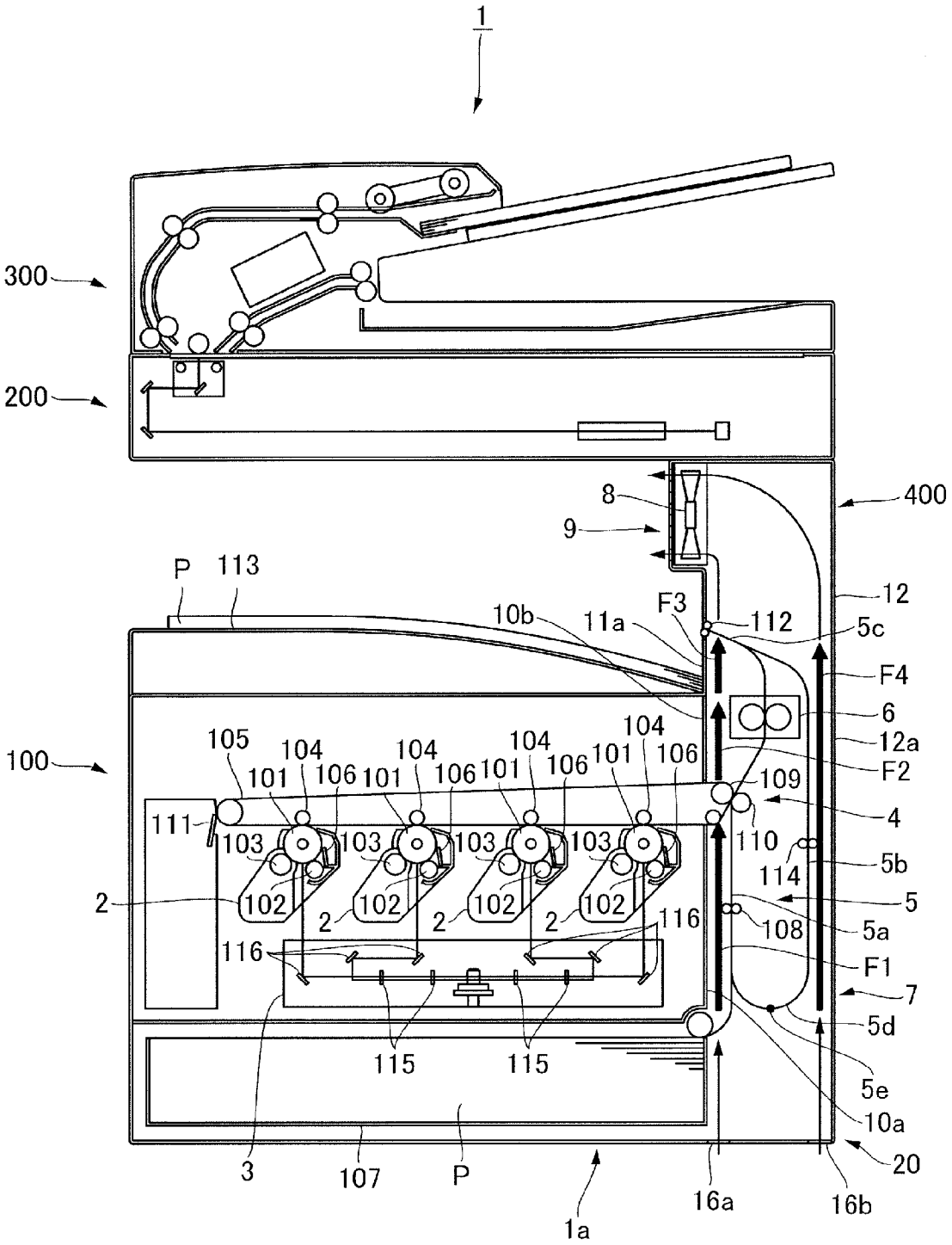
FIG. 1 is a schematic diagram illustrating a configuration of an image forming apparatus according to an embodiment of the invention.

As shown in FIG. 1, the image forming apparatus 1 of the present invention includes an image forming portion 100 configured to form an image on a recording medium such as a sheet of paper, a document reading portion 200 mounted above the image forming portion 100, and a document conveying portion 300 mounted above the document reading portion 200. The document reading portion 200 reads an image on a document, and the document conveying portion 300 conveys a document to the document reading portion 200. The document reading portion 200 is connected with the image forming portion 100 by a link portion 400.

According to the present embodiment, a discharge roller pair 112, i.e., a discharge portion, discharging a recording medium on which an image has been formed by the image forming portion 100, is disposed in the link portion 400. Accordingly, the recording medium is discharged by the discharge roller pair 112 to an intra-body space between the document reading portion 200 and the image forming portion 100. Therefore, a discharge tray 113 on which the discharged recording medium is stacked is disposed above the image forming portion 100.

The image forming portion 100 includes a plurality of image forming units 2 configured respectively to form toner images, a laser scanner 3, i.e., an exposure portion, an intermediate transfer belt 105, i.e., an intermediate transfer body, to which the toner images are transferred, and a secondary transfer portion 4, i.e., a portion transferring the toner images on the recording medium. The image forming apparatus 1 also includes a conveying path 5 disposed vertically so as to be adjacent the image forming portion 100 in a state in which the apparatus is installed and conveying the recording medium, and a fixing unit 6, i.e., an image heating portion/heating unit, disposed above the secondary transfer portion 4 along the conveying path 5 and configured to heat the image formed on the recording medium. The image forming apparatus 1 further includes an air current guide portion 7 disposed along the conveying path 5 such that air flows from a lower part to an upper part of the apparatus in the installed condition. Thus, the air current guide portion 7 is disposed adjacent the image forming portion 100.

The plurality of image forming units 2 form yellow, magenta, cyan, and black toner images, respectively, for example and are arrayed along a turning direction of the intermediate transfer belt 105. Each of the plurality of image forming units 2 includes a photoconductive drum (image carrier) 101. Disposed around each photoconductive drum 101 are a charging roller (charging portion) 102, a developer (developing portion) 103, a primary transfer roller (primary transfer portion) 104, and a photoconductive drum cleaner 106.

The image forming unit 2 includes a secondary transfer inner roller 109 rotatably supporting the intermediate transfer belt 105 and a secondary transfer outer roller 110 disposed so as to interpose the intermediate transfer belt 105 between the secondary transfer outer roller 110 and the secondary transfer inner roller 109. Then, the toner image on the intermediate transfer belt 105 is transferred to the recording medium by a secondary transfer bias applied from a power source not shown. The fixing unit 6 heats the image formed on the recording medium. That is, the toner image transferred to the recording medium in the secondary transfer portion 4 is fixed to the recording medium by heating and pressing the toner image in the present embodiment.

The conveying path 5 includes a conveying path 5*a*, i.e., a first conveying portion, a duplex conveying path 5*b*, i.e., a second conveying portion, and a discharging path 5*c*. The conveying path 5*a* is configured to convey the recording medium P from a sheet feed cassette 107 storing the recording medium P such that the recording medium P passes through the secondary transfer portion 4 and the fixing unit 6. The duplex conveying path 5*b* is configured to convey the recording medium heated by the fixing unit 6 in a direction opposite from a recording medium conveying direction of the conveying path 5*a*. The discharging path 5*c* is configured to convey the recording medium P from the conveying path 5*a* to the discharge roller pair 112. The discharging path 5*c* is also connected to an upstream end in the recording medium conveying direction of the duplex conveying path 5*b* to be able to convey the recording medium P conveyed from the conveying path 5*a* to the duplex conveying path 5*b* by switching back the recording medium P through the discharging path 5*c*. An upstream side in the recording medium conveying direction of the conveying path 5*a* is connected with a downstream end in the recording medium conveying direction of the duplex conveying path 5*b* by a connecting path 5*d*, and the recording medium P conveyed through the duplex conveying path 5*b* is conveyed to the conveying path 5*a* again by going through the connecting path 5*d*.

The air current guide portion 7 includes an air channel F1, i.e., a first guide portion, an air channel F2, i.e., a second guide portion, and an air channel F3, i.e., a third guide portion, disposed along the conveying path 5*a* and the discharging path 5*c*, and an air channel F4, i.e., a fourth guide portion, disposed along the duplex conveying path 5*b*. The image forming apparatus 1 is also provided with intake ports 16*a* and 16*b* formed through a lower part of a casing 1*a* thereof such that outside air flows into the air current guide portion 7 from the intake ports 16*a* and 16*b* through an intake air guide portion 20. The present embodiment is arranged such that air flows in from the intake port 16*a* to the air channels F1 through F3 through an intake air guide path 20*a* and flows in from the intake port 16*b* to the air channel F4 through an intake air guide path 20*b*, respectively. However, intake ports of the air channels F1 through F4 may be made in common. In this case, air flown into from the common intake port is branched by the intake air guide portion to be guided to the air channels F1 through F4. Detailed structures of the conveying path 5, the air current guide portion 7 and the intake air guide portion 20 will be described later.

Provided above the discharge roller pair 112 of the link portion 400 are an exhaust fan 8 as an air current generating unit and an exhaust port 9. As the exhaust fan 8 is driven, an air current is generated within the air current guide portion 7. That is, the air is taken in through the intake ports 16*a* and 16*b*, flows through the air current guide portion 7, and is exhausted from the exhaust port 9. The exhaust port 9 disposed at the intra-body space between the document reading portion 200 and the image forming portion 100. This configuration allows heat and noise to be output from the exhaust port 9 to be fully attenuated by intervening air existing before the heat and noise are transmitted to front, rear, right and left surfaces of the image forming apparatus 1 distant respectively from the exhaust port 9 by predetermined distances. Accordingly, it is possible to reduce influences of the heat and noise to a user who works around the surfaces of the image forming apparatus 1 and to improve usability of the image forming apparatus 1. Still further, because the exhaust port 9 is not closed even if the side surface of the image forming apparatus 1 is installed side by side with a wall, it is possible to reduce an installation space and to improve instability of the image forming apparatus 1.

An image forming process of the image forming apparatus 1 constructed as described above will be described. At first, the image forming apparatus 1 forms an image by the image forming portion 100 on a basis of information of an image on a document read by the document reading portion 200 or image information sent from an external terminal such as a personal computer. Specifically, a surface of the photoconductive drum 101 is homogeneously charged by the charging roller 102. After that, the surface of the photoconductive drum 101 is exposed by the laser scanner 3 driven on a basis of signals of the transmitted image information to forma latent image. The latent image is developed as a toner image by the developer 103. The toner images on the respective photoconductive drums 101 are transferred sequentially to the intermediate transfer belt 105 by a predetermined pressure and an electrostatic minus bias (primary transfer bias) applied by the primary transfer roller 104. After the transfer, residual toner slightly remaining on the photoconductive drum 101 is removed and recovered by the photoconductive drum cleaner 106 to be ready to be used in forming a next image.

Meanwhile, the recording medium P fed one by one from the sheet feed cassette 107 disposed at the lower part of the image forming portion 100 is guided to the conveying path 5*a*. A skew of the recording medium P is corrected in the conveying path 5*a* by making the recording medium P follow an edge of a nip portion of the registration roller pair 108. After that, the registration roller pair 108 conveys the recording medium P to the secondary transfer portion 4 by synchronizing with the toner image on the intermediate transfer belt 105. The toner image on the intermediate transfer belt 105 is then transferred to the recording medium P by a predetermined pressure and an electrostatic minus bias (secondary transfer bias) applied at the secondary transfer nip composed of the secondary transfer inner roller 109 and the secondary transfer outer roller 110. After the transfer, residual toner slightly remaining on the intermediate transfer belt 105 is removed and recovered by the transfer cleaner 111 to be ready to be used again in forming a next image. The transferred toner image on the recording medium P is fixed to the recording medium P by being heated and pressed by the fixing unit 6, and the recording medium P on which the toner image has been fixed is discharged on the discharge tray 113 by the discharge roller pair 112.

In a case of forming images on both faces of the recording medium P, the recording medium P on which an image has been formed on a first surface thereof is sent to the discharging path 5*c* and is conveyed to the duplex conveying path 5*b* while changing front and rear edges of the recording medium P by normal and reverse operations (switchback operation) of the discharge roller pair 112. Then, the recording medium P conveyed to the duplex conveying path 5*b* is conveyed by a duplex conveying roller pair 114 again to the registration roller pair 108 through the connecting path 5*d*. Then, an image is formed on a second surface (back surface) of the recording medium P through the similar process performed on the first surface, and the recording medium P is discharged onto the discharge tray 113.

At this time, because the exhaust fan 8 is disposed fully above the discharge tray 113, the air current from the exhaust fan 8 does not disturb alignment of the recording medium P stacked on the discharge tray 113 by coming down in contact with the recording medium P.

[Conveying Path]

Next, a specific structure of the conveying path 5 described above will be explained with reference to FIG. 2. As described above, the conveying path 5 is composed of the conveying path 5*a*, i.e., a first conveying portion, the duplex conveying path 5*b*, i.e., a second conveying portion, and the discharging path 5*c*. The conveying path 5*a* includes a first guide plate portion 15 guiding the recording medium, the duplex conveying path 5*b* includes a second guide plate portion 19 guiding the recording medium, and the discharging path 5*c* includes discharge guide plate portions 17 and 18 guiding the recording medium, respectively. These first and second guide plate portions 15, 19 and the discharge guide plate portions 17 and 18 compose a conveyance guide plate.

The first guide plate portion 15 is disposed substantially vertically from the intake port 16*a* to the secondary transfer portion 4 and is disposed aslant from the vertical direction at downstream in the recording medium conveying direction of the secondary transfer portion 4 such that the first guide plate portion 15 heads toward the fixing unit 6. The second guide plate portion 19 is disposed substantially vertically from the intake port 16*b*. The discharge guide plate portion 17 is disposed curvedly so as to be able to smoothly guide the recording medium from the fixing unit 6 to the discharge roller pair 112. The discharge guide plate portion 18 is disposed above the discharge guide plate portion 17 aslant from the vertical direction between the discharge roller pair 112 and the duplex conveying path 5*b*.

Partition walls 10*a* and 10*b*, i.e., a first wall portion, are disposed so as to face a recording medium conveying surface of the first guide plate portion 15, and a vertical wall 11*a*, i.e., the first wall portion, is disposed so as to face recording medium conveying surfaces of the discharge guide plate portions 17 and 18, respectively. The partition walls 10*a* and 10*b* isolate the conveying path 5 and the air current guide portion 7 from a space in which the image forming unit 2, the laser scanner 3, the intermediate transfer belt 105 and others are stored. The vertical wall 11*a* isolates an interior of the link portion 400 from the intra-body space. A side wall 12*a*, i.e., a second wall portion, is disposed so as to face a recording medium conveying surface of the second guide plate portion 19. These partition walls 10*a* and 10*b*, the vertical wall 11*a* and the side wall 12*a* compose wall members.

The partition walls 10*a* and 10*b* include pluralities of ribs 10*c* and 10*d* projecting in a direction of the first guide plate portion 15 which faces the partition walls 10*a* and 10*b* and guides the air flowing through the air channels F1 and F2. The pluralities of ribs 10*c* and 10*d* are disposed respectively in the vertical direction with predetermined intervals in a width direction intersecting the recording medium conveying direction. The conveying path 5*a* conveys the recording medium between the first guide plate portion 15 and the pluralities of ribs 10*c* and 10*d*. Due to that, a gap around 1 to 4 mm for example suitable for conveying the recording medium is provided between edges of the plurality of ribs 10*c* and 10*d* and the first guide plate portion 15. It is noted that a distance between the first guide plate portion 15 and the plurality of ribs 10*d* at a part from the secondary transfer portion 4 to the fixing unit 6 is widened more than the gap described above so that the toner image transferred to the recording medium does not come in contact with the ribs.

The vertical wall 11*a* includes a plurality of ribs 11*b* projecting in a direction of the discharge guide plate portions 17 and 18 that face the vertical wall 11*a* and guiding the air flowing through the air channel F3. The plurality of ribs 11*b* is disposed respectively vertically with predetermined intervals in the width direction. The discharging path 5*c* conveys the recording medium between the discharge guide plate portions 17 and 18 and the plurality of ribs 11*b*. A gap of around 1 to 4 mm for example suitable for conveying the recording medium is also provided between the edges of the plurality of ribs 11*b* and the discharge guide plate portions 17 and 18. Due to that, the edges of the plurality of ribs 11*b* are curved and inclined so that they follow the shapes of the discharge guide plate portions 17 and 18. Specific configurations of the plurality of ribs 10*c*, 10*d* and 11*b* will be explained with reference to FIG. 4 described later.

The side wall 12*a* includes a plurality of ribs 12*d* projecting in a direction of the second guide plate portion 19 that faces the side wall 12*a* and guiding the air flowing through the air channel F4. The plurality of ribs 12*d* is disposed vertically with predetermined intervals in the width direction respectively. A gap of around 1 to 4 mm for example suitable for conveying the recording medium is also provided between the edges of the plurality of ribs 12*d* and the second guide plate portion 19. A specific configuration of the plurality of ribs 12*d* will be explained with reference to FIG. 5 described later.

[Heat Generating Source and Exhaust Heat]

Next, heat generating sources and heat exhausting operations of the image forming apparatus 1 will be described with reference to FIG. 1. Firstly, because the fixing unit 6 has a heating function as described above, it is a heat generating source. The recording medium P that has passed through the fixing unit 6 is also a heat generating source because the toner image as well as the recording medium P itself are heated and keep high temperature. The exhaust heat from the heat generating source warms up an ambient air, and the warmed-up air moves upward as its specific weight is lightened due to its thermal expansion and increases an ambient temperature at a place where the air has moved.

If a temperature of the laser scanner 3 rises excessively due to the increase of the ambient temperature, there is a possibility of causing displacement of a lens 115 and a return mirror 116 due to thermal expansion of a supporting portion and a change of refractive index of the lens 115. In such a case, there is a possibility that it is unable to obtain a favorable output image as an image forming position and an image forming diameter on the photoconductive drum 101 fluctuate. Still further, if temperatures of the image forming unit 2, the intermediate transfer belt 105 and others rise excessively, there is also a possibility that it is unable to obtain a favorable output image by causing a change of resistance values of the charging roller 102 and the primary transfer roller 104 or fixation and coagulation of the toner.

According to the present embodiment, the respective image forming units 2 of Y (yellow), M (magenta), C (cyan), and Bk (black) are arrayed substantially in the horizontal direction. The laser scanner 3 is disposed under the image forming unit 2, and the intermediate transfer belt 105 is disposed above the image forming unit 2. The conveying path 5*a* extending substantially in the vertical direction on sides of the image forming unit 2, the laser scanner 3, and the intermediate transfer belt 105 is disposed through the partition walls 10*a* and 10*b* as described above. The fixing unit 6 is disposed above the secondary transfer portion 4 along the conveying path 5*a*. The duplex conveying path 5*b* extends substantially in the vertical direction along an inner side surface of a side wall 12*a* of a cover 12 composing the casing 1*a* of the image forming apparatus 1 and storing the conveying path 5, the air current guide portion 7, the intake air guide portion 20, the secondary transfer portion 4, the fixing unit 6, and others. Then, the duplex conveying path 5*b* joins the conveying path 5*a* through the connecting path 5*d* at a position adjacent the laser scanner 3. The exhaust fan 8 is disposed above the conveying path 5*a*, the duplex conveying path 5*b* and the discharging path 5*c* in the link portion 400 above the image forming portion 100.

It can be seen from the layout of the heat generating sources described above that it is preferable to install the air current guide portion 7 along the conveying path 5 of the recording medium in order to efficiently exhaust heat within the image forming apparatus. To that end, according to the present embodiment, the air current guide portion 7 is composed of the air channels F1 through F4 disposed as described above. Specifically, the exhaust heat generated from heat generating sources such as the fixing unit 6 and the recording medium P conveyed to the discharge roller pair 112 after fixation moves upward via the air channel F3 along the vertical wall 11*a*. Then, it is possible to suppress the increase of the ambient temperature of the space storing the image forming unit 2, the laser scanner 3, the intermediate transfer belt 105 and others by exhausting such exhaust heat out of the apparatus by the exhaust fan 8 through the air channel F3.

Still further, the exhaust heat generated from the recording medium P conveyed to the duplex conveying path 5*b* after fixation moves upward via the air channel F4 in the path from the duplex conveying path 5*b* to a lowest point 5*e* of the connecting path 5*d* and is exhausted out of the apparatus by the exhaust fan 8. Meanwhile, the exhaust heat generated from the recording medium P moves upward via the air channels F1 and F2 in the path from the lowest point 5*e* to the conveying path 5*a* of the connecting path 5*d*. The partition walls 10*a* and 10*b* isolate the conveying path 5*a* from the space storing the image forming unit 2, the laser scanner 3, the intermediate transfer belt 105 and others. Therefore, it is possible to suppress the exhaust heat from flowing into and from increasing the ambient temperature of the space storing the image forming unit 2, the laser scanner 3, the intermediate transfer belt 105 and others. Along with that, the exhaust heat is exhausted out of the apparatus by the exhaust fan 8 through the air channels F1 and F2 as well as the air channel F3 located above them. This configuration makes it possible to suppress the increase of the ambient temperature of the space storing the image forming unit 2, the laser scanner 3, the intermediate transfer belt 105 and others by the exhaust heat generated by the recording medium P conveyed to the duplex conveying path 5*b* after the fixation.

According to the present embodiment, the layout of the heat generating sources and the air channels as described above makes it possible to move the exhaust heat generated from the respective heat generating source upward through either one of the air channels F1 through F4 and to exhaust out of the apparatus by the exhaust fan 8. Therefore, even if the exhaust port 9 is disposed at the intra-body space, it is possible to obtain a favorable output image without excessively increasing the ambient temperature of the space storing the image forming unit 2, the laser scanner 3, the intermediate transfer belt 105 and others.

It is preferable to use a low thermal conductive material such as a synthetic resin in general or a foamed resin in which air bubbles are distributed in a synthetic resin as the partition walls 10*a* and 10*b* disposed along the air channels F1 and F2 because a heat insulating effect of the partition walls 10*a* and 10*b* can be improved. The general synthetic resin may be also used as the vertical wall 11*a* and the side wall 12*a* disposed along the air channels F3 and F4. However, it is also preferable to use a high thermal conductive material such as metal and a synthetic resin into which thermal conductive fillers such as metal are blended because the exhaust heat from the heat generating source can be efficiently conducted and irradiated to the outside of the apparatus through the vertical wall 11*a* and the side wall 12*a*.

[Air Current Guide Portion]

Next, a specific configuration of the air current guide portion 7 will be explained with reference to FIGS. 2 through 5. At first, in the present embodiment, the air current guide portion 7 is constructed such that a relationship of R1>R2>R3>R4 holds, where the R1, R2, R3 and R4 are channel resistances in each of the air channels F1, F2, F3 and F4 composing the air current guide portion 7. That is, an airflow resistance of the air flowing through the air channel F2 downstream in an air current direction of the air channel F1 is reduced to be less than that of the air flowing through the air channel F1. Still further, an airflow resistance of the air flowing through the air channel F3 downstream in the air current direction of the air channel F2 and flowing the air from the air channel F2 to the discharge guide plate portions 17 and 18 is reduced to be less than that of the air flowing through the air channel F2. An airflow resistance of the air flowing through the air channel F4 disposed along the duplex conveying path 5*b* is reduced further to be less than that of the air flowing through the air channel F3.

Air hardly flows from a side where a channel resistance is low to a side where a channel resistance is high in general. Accordingly, because R1>R2>R3, the flow of the air heading upward via the air channels F1, F2, and F3 is accelerated and the exhaust heat generated from each heat generating source can be efficiently exhausted. Still further, because (R1, R2, R3)>R4, the exhaust heat generated from the recording medium P conveyed through the fixing unit 6 and the duplex conveying path 5*b* can be efficiently exhausted from a side of the air channel F4 whose channel resistance is low. Thus, this configuration makes it possible to exhaust the exhaust heat generated from the recording medium P efficiently out of the apparatus during when the recording medium P is conveyed through the duplex conveying path 5*b* and to reduce the exhaust heat generated from the recording medium P when the recording medium P is conveyed through the conveying path 5*a*. As a result, it is possible to suppress the exhaust heat generated from the recording medium P from affecting the image forming unit 2, the laser scanner 3, the primary transfer roller 104 and others.

The relationship of the channel resistance described above holds also in a state in which there is no forced convection caused by the exhaust fan 8. That is, because the air channels F1 through F4 are disposed in the vertical direction, the exhaustion of heat from the exhaust port 9 via the air channels F1 through F4 is continued by natural convection even after when the image forming operation has been finished and the exhaust fan 8 has been stopped. Accordingly, the ambient temperature of the space storing the image forming unit 2, the laser scanner 3, the intermediate transfer belt 105 and others does not rise excessively also during a stand-by time, and a favorable output image can be obtained when a next image forming operation is started.

If a channel resistance decreases in an air channel through which a predetermined quantity of air flows, a difference of pressures at an inflow port and an outflow port decreases. Accordingly, the relationship of magnitudes of the channel resistances R1 through R4 of the air channels F1 through F4 can be judged by measuring a static pressure S1 at each inflow port and a static pressure S2 at each outflow port in a condition of an air quantity when the exhaust fan 8 is operated and by obtaining a difference of the pressures (S1−S2). The channel resistance can be adjusted by changing either condition of areas of the inflow and outflow ports, a length of the air channel, a bending angle and a number of times of bending of the guide plates and the ribs composing the air channels, and surface roughness of the guide plates and the ribs for example. Accordingly, the areas of the inflow and outflow ports are widened, the length of the air channel is shortened, the bending angle or the number of times of bending of the guide plate and the ribs composing the air channel is reduced, or the surface roughness of a wall surface of the air channel is smoothed in order to reduce the channel resistance of the air channel. Thereby, the channel resistances R1 through R4 of the air channels F1 through F4 can be set as described above.

Figure 3:
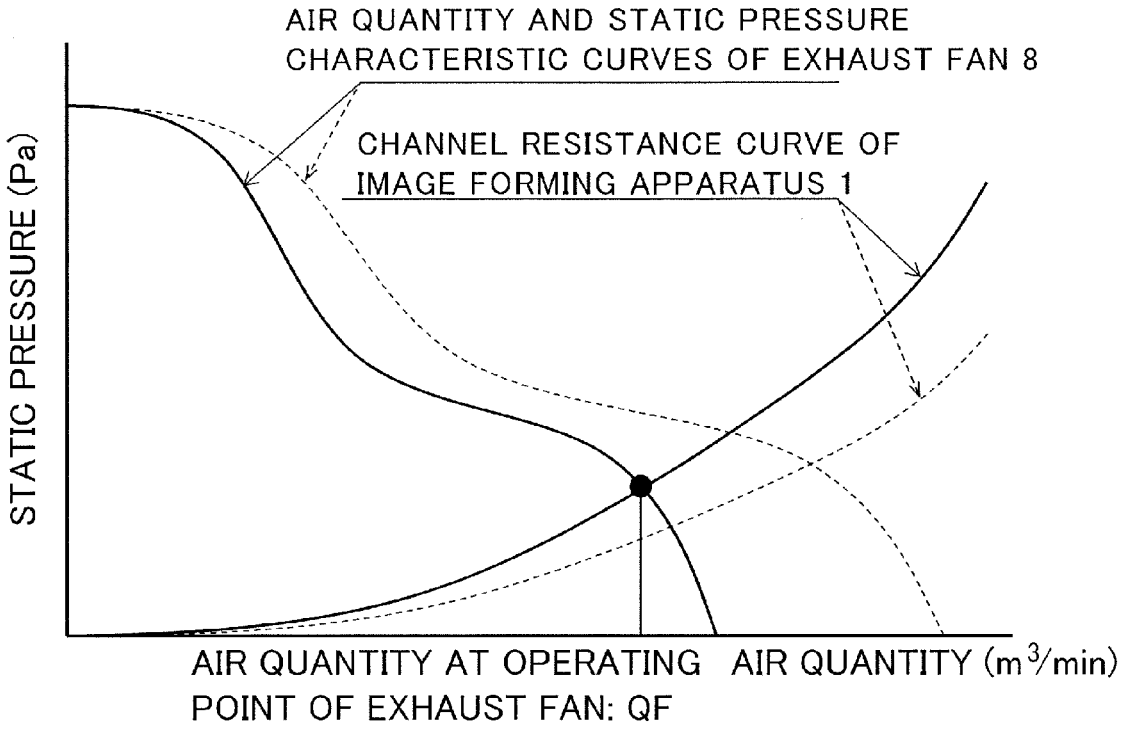
FIG. 3 is a graph representing a channel resistance curve of the air current guide portion of the image forming apparatus of the present embodiment and characteristics of an exhaust fan of the present embodiment.

Next, a relationship between the exhaust fan 8 and a channel resistance of the entire image forming apparatus 1 will be explained with reference to FIG. 3. FIG. 3 is a graph indicating a relationship between a channel resistance curve of the entire image forming apparatus 1 and an air quantity and static pressure characteristic curve of the exhaust fan 8. An air quantity (QF) at an operating point of the exhaust fan 8 is determined by an intersection of the channel resistance curve and the air quantity and static pressure characteristic curve. Accordingly, if a required air quantity is insufficient, the channel resistance of the entire image forming apparatus 1 is lowered or performance of the exhaust fan 8 is increased (as indicated by broken lines in FIG. 3) while maintaining the mutual relationship of the channel resistances R1 through R4 of the air channels F1 through F4. Or, the required air quantity is assured by carrying out the both of the adjustments described above.

It is noted that the channel resistance curve of the entire image forming apparatus 1 can be obtained by measuring the static pressure at several points by changing the air quantity condition of the exhaust fan 8 near the exhaust fan 8 where all of the air channels finally join. The air quantity and static pressure characteristic curve of the exhaust fan 8 can be measured by the blowing test under JIS B8330.

[Intake Air Guide Portion]

Next, the intake air guide portion 20 configured to guide the air to the air current guide portion 7 described above from the intake ports 16*a* and 16*b* will be explained with reference to FIGS. 2, 4 and 5. According to the present embodiment, the intake air guide portion 20 includes an intake air guide path 20*a* guiding the air from the intake port 16*a* to the air channel F1 and an intake air guide path 20*b* guiding the air from the intake port 16*b* to the air channel F4. These intake air guide paths 20*a* and 20*b* may be what directly connect the air channels F1 and F4 with the intake ports 16*a* and 16*b*, respectively, or may not be directly connected even though they are located between the air channels F1 and F4 and the intake ports 16*a* and 16*b*. In any case, the intake guide paths 20*a* and 20*b* will do if they guide the air from the intake ports 16*a* and 16*b* to the air channels F1 and F4, respectively. It is also preferable to equalize or increase a channel resistance of the intake air guide path 20*a* with or more than the channel resistance of the air channel F1. Meanwhile, it is preferable to equalize or increase a channel resistance of the intake air guide path 20*b* with or more than the channel resistance of the air channel F4 and to equalize or decrease the channel resistance of the intake air guide path 20*b* with or less than the channel resistance of the air channel F3. A specific configuration of the present embodiment will be described below.

Figure 2:
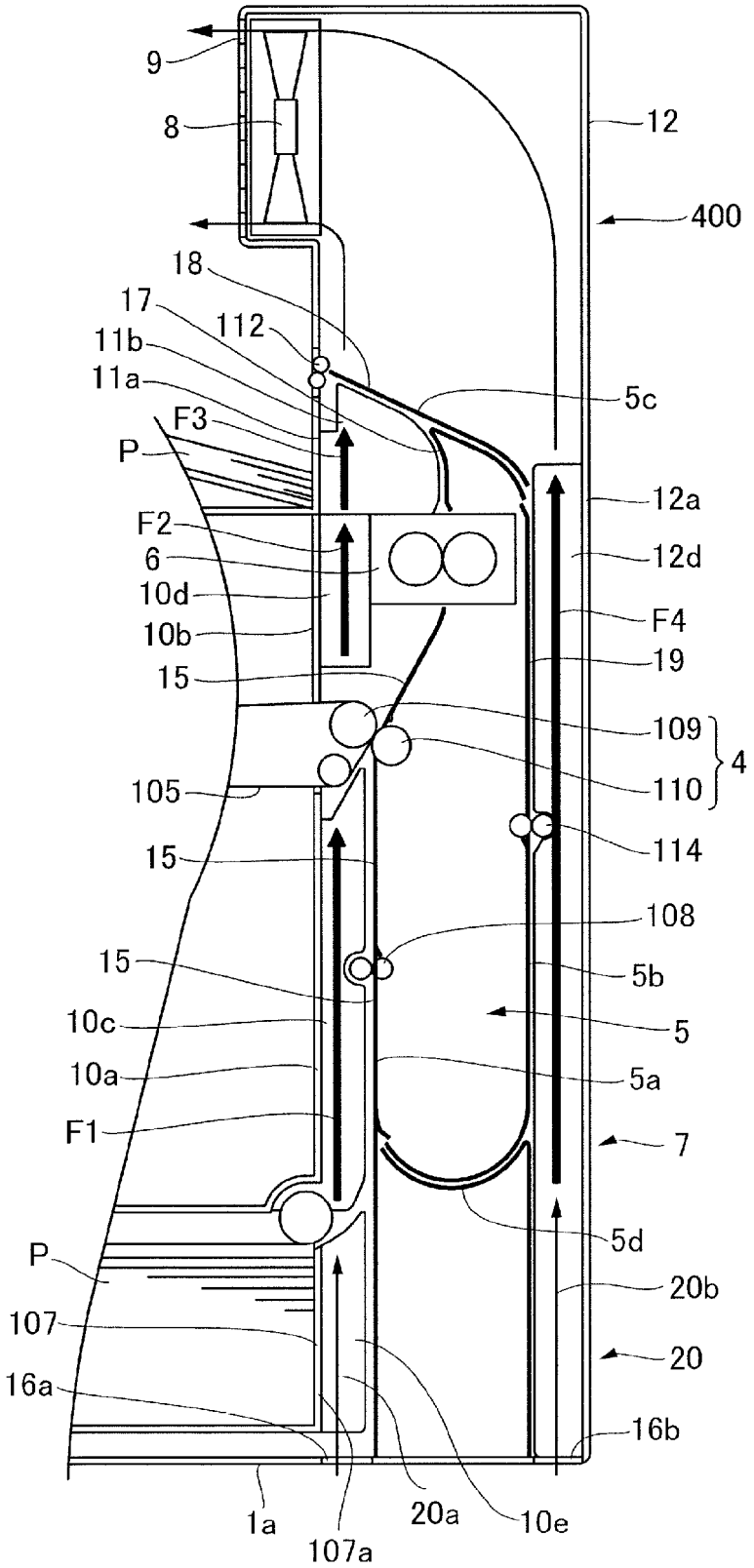
FIG. 2 is an enlarged section view showing a configuration of an air current guide portion of the present embodiment.
Figure 4:
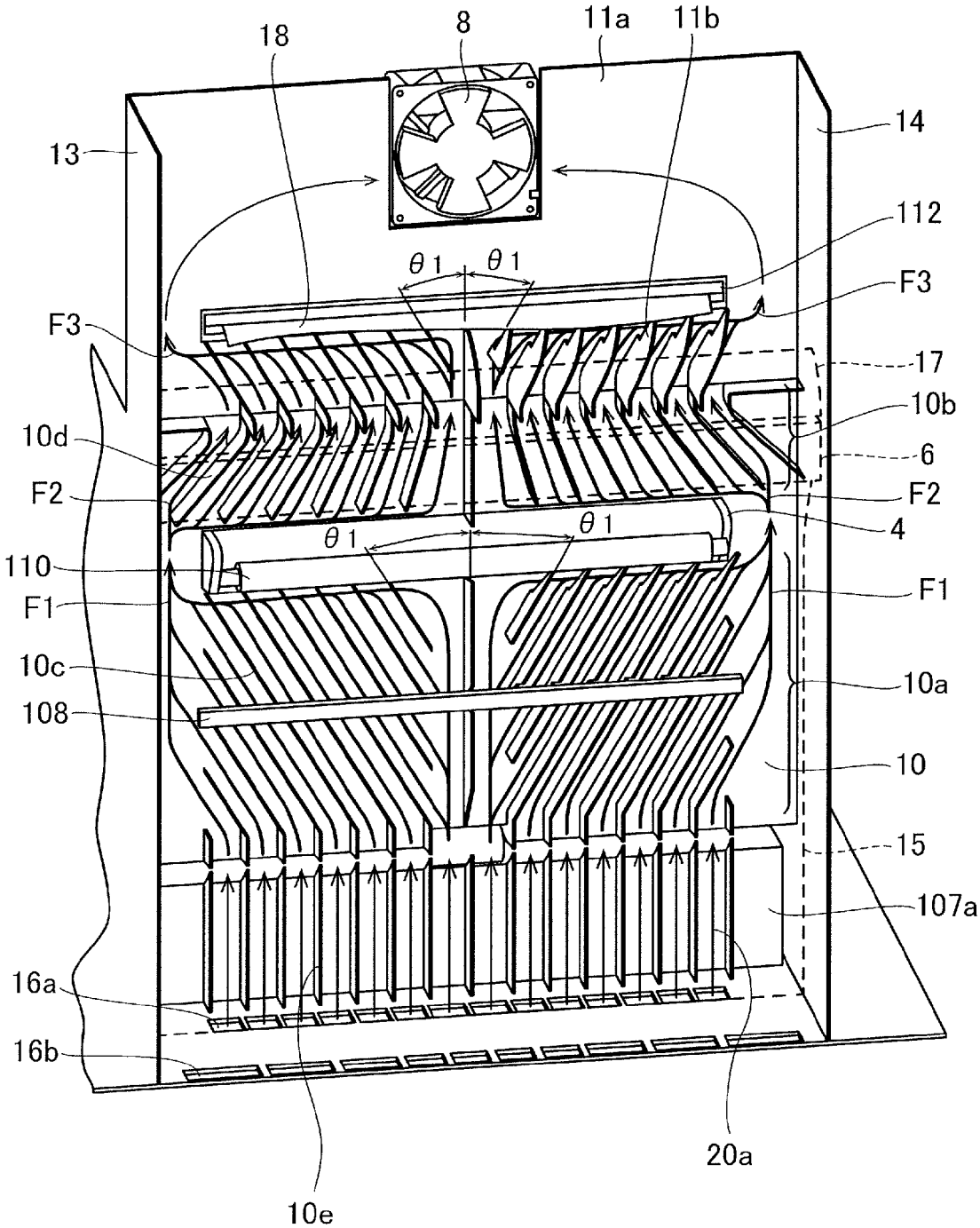
FIG. 4 is a partially-cut away perspective view showing a side guiding an air current of a first wall portion of the present embodiment.

As shown in FIGS. 2 and 4, each of the intake air guide path 20*a* is constructed as an air channel extending in the vertical direction, substantially having a rectangular section, and whose four side surfaces are closed by a side wall 107*a* of the sheet feed cassette 107, front and rear side plates 13 and 14 of the image forming portion 100 and a first guide plate portion 15. While the first guide plate portion 15 composes the air channel F1 as described later, the first guide plate portion 15 is extended to the intake port 16*a* and is used as a guide plate composing the intake air guide path 20*a* in the present embodiment. It is noted that the guide plate composing the intake air guide path 20*a* may be a separate member from the first guide plate portion 15.

A plurality of ribs 10*e* is formed integrally on the side wall 107*a* of the sheet feed cassette 107 similarly to the plurality of ribs 10*c* composing a sheet feed surface on a side opposite from the first guide plate portion 15 described later. The plurality of ribs 10*e* is formed in parallel with each other such that each interval of the adjacent ribs 10*e* is equalized with a width of the plurality of intake ports 16*a* and downstream ends thereof face closely to upstream ends of the plurality of ribs 10*c* of the air channel F1. Still further, the plurality of ribs 10*e* is configured such that parts between the downstream ends of the adjacent ribs 10*e* are collocated with parts between upstream ends of the adjacent ribs 10*c*. Thereby, outside air flown in from the plurality of intake ports 16*a* formed through the lower surface of the casing 1*a* is smoothly guided to the air channel F1 through the intake air guide path 20*a*. It is noted that the plurality of ribs 10*e* may be connected to the plurality of ribs 10*c* of the air channel F1. Still further, the upstream ends of the plurality of ribs 10*e* may be connected around the intake ports 16*a*.

Figure 5:
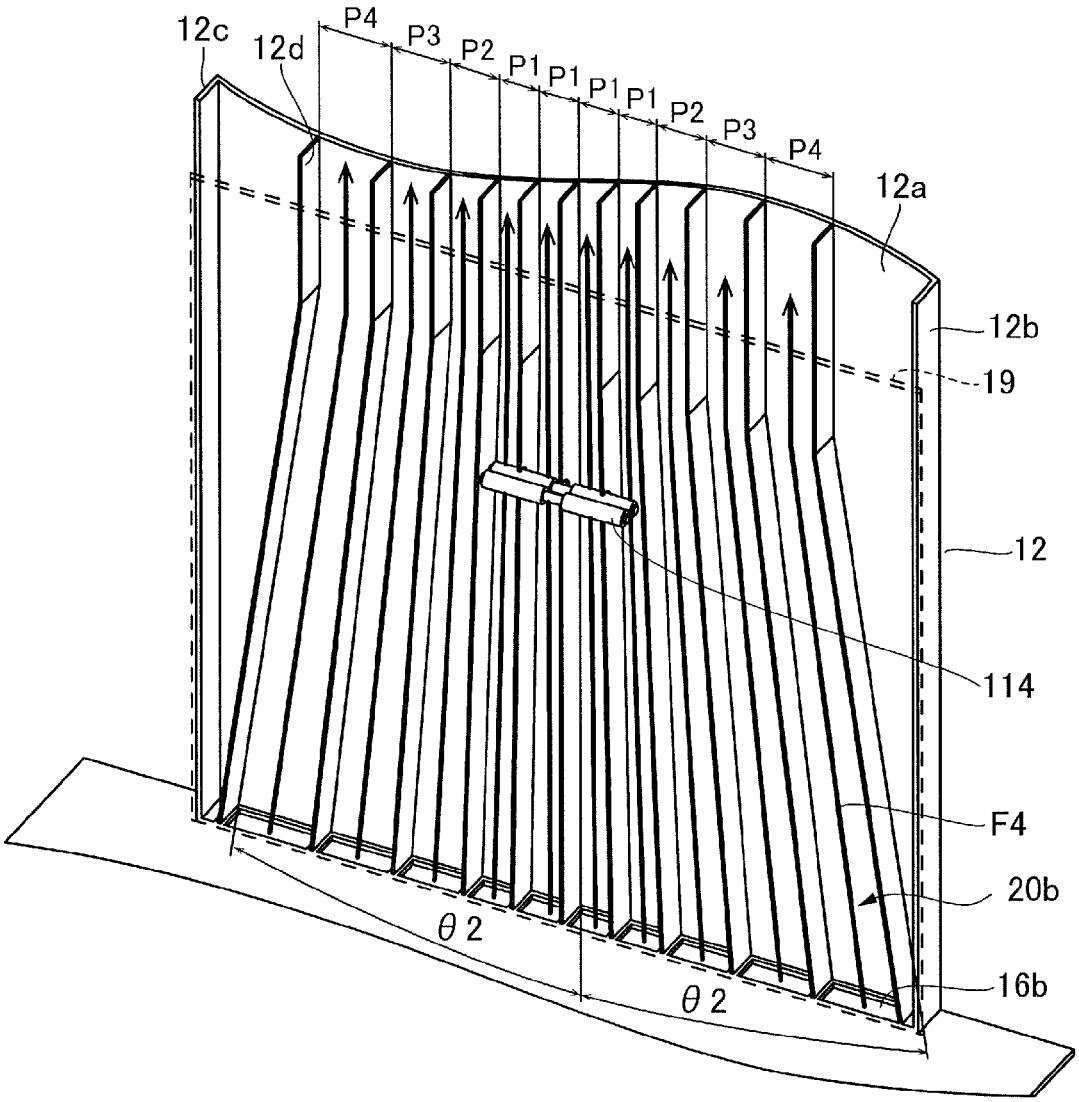
FIG. 5 is a partially-cut away perspective view showing a side guiding an air current of a second wall portion of the present embodiment.

Meanwhile, as shown in FIGS. 2 and 5, the intake air guide path 20*b* is constructed as an air channel extending in the vertical direction, having substantially a rectangular section, and whose four side surfaces are closed by the side wall 12*a* of the cover 12, a front wall 12*b*, a rear wall 12*c*, and the second guide plate portion 19. While the second guide plate portion 19 composes the air channel F4 as described later, the second guide plate portion 19 is used as a guide plate composing the intake air guide path 20*b* by extending further from the connecting path 5*d* to the intake port 16*b* side in the present embodiment. It is noted that the guide plate composing the intake air guide path 20*b* may be a separate member from the second guide plate portion 19.

A plurality of ribs 12*d* composing a sheet feed surface on a side opposite from the second guide plate portion 19 described later is formed integrally on the side wall 12*a* and upstream ends thereof extend to the intake ports 16*b*. Accordingly, the plurality of ribs 12*d* composes the air channel F4 and the intake air guide path 20*b*. Edges of each rib 12*d* faces the second guide plate portion 19 through a very small gap. The plurality of ribs 12*d* is formed such that intervals of the upstream ends of the adjacent ribs 12*d* are equalized with widths of the plurality of intake ports 16*a*. Still further, the plurality of ribs 12*d* is configured such that the closer to the upstream end, the wider the intervals of the adjacent ribs 12*d* become. Thereby, the outside air flown in from the plurality of intake ports 16*b* formed through the lower surface of the casing 1*a* is smoothly guided to the air channel F4 through the intake air guide path 20*b*. It is noted that the plurality of ribs of the intake air guide path 20*b* may be configured as separate members from the plurality of ribs 12*d* of the air channel F4 and such that end parts of the respective ribs face closely with each other.

[Detail of Configuration of Air Current Guide Portion]

Next, the specific structure of the air current guide portion 7 having the air channels F1 through F4 as described above will be explained with reference to FIGS. 2, 4 and 5. As shown in FIGS. 2 and 4, the air channel F1 is constructed as an air channel extending in the vertical direction, substantially having a rectangular section, and whose four side surfaces are closed by the partition wall 10*a* under the secondary transfer portion 4, the front and rear side plates 13 and 14 of the image forming portion 100, and the first guide plate portion 15. The plurality of ribs 10*c* composing the sheet feed surface on the side facing the first guide plate portion 15 is formed integrally on the partition wall 10*a* as described above. Because the edge of each rib 10*c* faces the first guide plate portion 15 through a very small gap, the air within the air channel F1 flows through wider spaces between the plurality of ribs 10*c*. The air within the air channel F1 flows between the plurality of ribs 10*c* also when the recording medium P is conveyed in contact with the edges of the plurality of ribs 10*c*.

Accordingly, the air warmed up within the air channel F1 by the exhaust heat from the heat generating source rises along the plurality of ribs 10*c*. Along with that, outside air is flown in from the plurality of intake ports 16*a* formed through the lower surface of the casing 1*a* and flows into the air channel F1 through the intake air guide path 20*a*. The plurality of ribs 10*c* is arrayed aslant in a direction extending in the width direction intersecting with the recording medium conveying direction as the plurality of ribs 10*c* extends upward. Then, the plurality of ribs 10*c* guides the air such that the air flows through widthwise both sides of the secondary transfer portion 4. In other words, the plurality of ribs 10*c* guides the air rising along the plurality of ribs 10*c* in directions enabling the air to bypass the secondary transfer portion 4 which blocks the air at an upper part of the plurality of ribs 10*c*. At this time, it is preferable to set an angle θ1 formed between the plurality of ribs 10*c* and the recording medium conveying direction within a range of 0 to 30°. If the angle θ1 is larger than 30°, a front edge of the recording medium P being conveyed tends to be caught by the ribs 10*c*. However, it is possible to suppress the front edge of the recording medium P from being caught by the ribs 10*c* and to favorably convey the recording medium P by setting the angle θ1 as described above.

It is noted that while the widthwise intervals of the plurality of ribs 10*c* may be equalized, the intervals at a widthwise center part may be also larger than the intervals on both sides of the plurality of ribs 10*c*. This arrangement makes it possible to reduce resistance of the air flowing between the ribs 10*c* at the widthwise center part to be less than resistance of the air flowing through the both sides of the ribs 10*c* and to readily guide the air flowing through the center part efficiently to the widthwise both sides of the secondary transfer portion 4.

The air channel F2 is disposed such that the secondary transfer portion 4 is interposed between the air channel F1 and the air channel F2. That is, the air channel F2 is constructed as an air channel extending in the vertical direction, having substantially a rectangular section, and whose four side surfaces are closed by the partition wall 10*b* above the secondary transfer portion 4, the front and rear side plates 13 and 14, the first guide plate portion 15 and an outer wall of the fixing unit 6. A plurality of ribs 10*d* aslant in a direction of converging to the widthwise center as the ribs 10*d* extend upward is formed integrally on the partition wall 10*b* to guide the air that has been guided in the direction of bypassing to the widthwise both sides of the secondary transfer portion 4 in the air channel F1 toward the widthwise center direction again. It is noted that because the partition wall 10*b* is located at a position fully distant from the first guide plate portion 15, an inclination angle of the plurality of ribs 10*d* is not restricted by the conveyance of the recording medium and may be adequately adjusted such that the ribs 10*d* can readily guide the air.

Still further, while the widthwise intervals of the plurality of ribs 10*d* may be also equalized, the intervals of the widthwise center part may be larger than the intervals of the both sides. This arrangement makes it possible to reduce resistance of the air flowing between the ribs 10*d* at the widthwise center part to be less than that flowing through the both sides and to make the air flowing from the widthwise both sides of the secondary transfer portion 4 readily flow to the center part.

The air channel F3 is an air channel flowing the air from the air channel F2 to the discharge guide plate portions 17 and 18. That is, the air channel F3 is constructed as an air channel extending in the vertical direction, substantially having a rectangular section, and whose four sides are closed by the vertical wall 11*a*, the front and rear side plates 13 and 14, and the discharge guide plate portions 17 and 18. A plurality of ribs 11*b* guiding the recording medium P from the fixing unit 6 to the discharge roller pair 112 is formed integrally on the vertical wall 11*a*. Because an upper part of the air channel F3 is covered by the discharge guide plate portion 18, the plurality of ribs 11*b* is disposed aslant in the direction extending to the both sides as the plurality of ribs 11*b* extends upward, similarly to the air channel F1, such that the air is guided in a direction in which the air can readily bypass the discharge guide plate portion 18 in the present embodiment. An inclination angle θ1 of the plurality of ribs 11*b* with respect to the recording medium conveying direction is set within a range of 0 to 30° similarly to the air channel F1, so that the front edge of the recording medium P is hardly caught by the plurality of ribs 11*b*.

It is noted that while the widthwise intervals of the plurality of ribs 11*b* may be equalized, the intervals at the widthwise center part may be larger than the intervals of the ribs 11*b* at the both sides. This arrangement makes it possible to reduce resistance of the air flowing between the ribs 11*b* at the widthwise center part to be less than that of the both sides and to readily guide the air flowing the center part efficiently to the widthwise both sides of the discharge guide plate portion 18.

The mutual relationship of the channel resistances R1>R2>R3 described above is made to hold by constructing the air channels F1, F2 and F3 described above such that the lengths of the air channels are long in the order of F1>F2>F3. However, it is also possible to adjust the channel resistance by changing the intervals of the ribs and the bending angle of the air channels even if the lengths of the air channels are reversed.

As shown in FIGS. 2 and 5, the air channel F4 is constructed as an air channel extending in the vertical direction, substantially having a rectangular section, and whose four side surfaces are closed by the side, front and rear walls 12*a*, 12*b* and 12*c* of the cover 12 and the second guide plate portion 19. The plurality of ribs 12*d* composing the sheet feed surface on the side opposite from the second guide plate portion 19 is formed integrally on the side wall 12*a*. Because the edge of each rib 12*b* faces the second guide plate portion 19 through a very small gap, the air within the air channel F4 flows between the plurality of ribs 12*d* having wider spaces. The air within the air channel F4 also flows between the plurality of ribs 12*d* during when the recording medium P is conveyed in contact with the edges of the plurality of ribs 12*d*.

Accordingly, the air warmed up within the air channel F4 by exhaust heat from the heat generating source rises along the plurality of ribs 12*d*. Along with that, outside air flows in from the plurality of intake ports 16*b* formed through the lower surface of the casing 1*a* through the intake air guide path 20*b*. It is not necessary to bend the air channel unlike the air channels F1 through F3 by inclining the plurality of ribs 12*d* to bypass what blocks above the ribs 12*d* in the air channel F4. Due to that, it is possible to lessen the channel resistance of the air channel F4 even though the length of the air channel is long as compared to the air channels F1 through F3 which need to be bent.

Still further, as shown in FIG. 5, it is possible to widen an area of the intake port 16*b* and to lessen the channel resistance by inclining the plurality of ribs 12*d* in a direction extending in the widthwise both sides as the plurality of ribs 12*d* head down to the intake port 16*b*. At this time, it is possible to make the front edge of the recording medium P been hardly caught by the plurality of ribs 12*d* by setting a maximum angle θ2 formed between the plurality of ribs 12*d* and the recording medium conveying direction to be within a range of 0 to 30°.

Still further, among the plurality of ribs 12*d*, widthwise intervals of the ribs 12*d* (first ribs) disposed at position closer widthwise to the exhaust fan 8 are narrowed more than intervals of the ribs 12*d* (second ribs) disposed at position distant from the exhaust fan 8 more than the first ribs. Specifically, the intervals P2 through P4 of the ribs 12*d* positioned widthwise outer sides of the exhaust fan 8 with respect to the intervals P1 of the ribs 12*d* positioned within a widthwise range of the exhaust fan 8 are widened as the ribs 12*d* become distant from the exhaust fan 8 (P1<P2<P3<P4). This arrangement makes it possible to guide substantially an equal amount of air among the respective ribs 12*d* regardless of the distance from the exhaust fan 8 by widening the intervals between the ribs 12*d* to reduce the channel resistance, even though an air suction effect of the exhaust fan 8 is normally weakened as the ribs 12 become distant from the exhaust fan 8. Accordingly, it is possible to preferably cool the recording medium P conveyed to the duplex conveying path 5*b* homogeneously in the width direction.

According to the present embodiment, it is not necessary to provide new ducts or the like because the air is flown respectively among the first guide plate portion 15, the second guide plate portion 19, the discharge guide plate portions 17 and 18, the partition walls 10*a* and 10*b*, the side wall 12*a* and the vertical wall 11*a* as described above. Still further, the respective air channels F1 through F4 are disposed as described above and the air is exhausted collectively through one exhaust fan 8, it is not necessary to provide a fan per every air channel. It is noted that although a plurality of exhaust fans may be provided in order to assure a predetermined quantity of air, it is not necessary to provide a fan per every air channel also in this case. Accordingly, it is possible to suppress the size and cost of the apparatus from increasing.

Still further, because the respective air channels F1 through F4 composing the air current guide portion 7 are disposed along the conveying path 5, the exhaustion of the exhaust heat generated from the heat generating sources such as the fixing unit 6 disposed along the conveying path 5 and the recording medium passing through the fixing unit 6 may be efficiently carried out. That is, the heat generated from the fixing unit 6 can be efficiently exhausted through the air channel F3. The exhaust heat generated from the recording medium conveyed to the duplex conveying path 5*b* by passing through the fixing unit 6 can be efficiently exhausted through the air channel F4. Still further, the exhaust heat generated from the recording medium conveyed from the duplex conveying path 5*b* to the conveying path 5*a* can be efficiently exhausted through the air channels F1 through F3.

It is noted that the sheet feed surface on the side facing the wall members (10*a*, 10*b*, 11*a*, and 12*a*) facing the conveyance guide plates (15, 17, 18 and 19) composing the air channels F1 through F4 has been explained as a guide guiding the recording medium in the explanation described above. However, the present invention is not limited to such configuration. For instance, a conveyance guide plate guiding the sheet feed surface may be provided anew on the side of the wall members (10*a*, 10*b*, 11*a*, and 12*a*) to compose an air channel between the wall member and the new conveyance guide plate. That is, the recording medium may be conveyed between the conveyance guide plate (15, 17, 18 and 19) and the new conveyance guide plate and the air current guide portion may be constructed between the wall member and the new conveyance guide plate.

The present invention is also applicable to a configuration in which the conveying paths and the air current guide portion are disposed in the horizontal direction, other than the configuration in which they are disposed in the vertical direction. That is, in the case of the configuration in which the conveying paths of the recording medium are disposed in the horizontal direction, the air current guide portion is also disposed in the horizontal direction. However, the exhaustion of heat may be readily carried by the natural convention if the air current guide portion is inclined upward as the air channels approach the exhaust port also in this case.

As described above, the present invention makes it possible to unnecessitate new ducts and others because the air is flown between the conveyance guide plate guiding the recording medium and the wall member and to suppress the size and cost of the apparatus from being increased. Still further, because the air current guide portion is disposed along the conveying paths, the exhaust heat generated from the heat generating sources such as the heating unit disposed along the conveying path and the recording medium that has passed through the heating unit can be efficiently exhausted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-132634, filed Jun. 25, 2013, which is hereby incorporated by reference herein in its entirety.

What is claimed is:

1. An image forming apparatus comprising:

an image forming portion, including an image bearing member, configured to form an image on an image bearing member;

a transferring portion configured to transfer the image to a sheet;

an image heating portion, disposed above the transferring portion, configured to heat the image formed on the sheet;

a discharging portion, disposed above the heating portion, configured to discharge the sheet heated by the heating portion;

a sheet containing portion, disposed below the transferring portion, configured to contain the sheet;

a plurality of first conveyance guide ribs, disposed between the transferring portion and the sheet containing portion, configured to guide the sheet conveyed upward from the sheet containing portion toward the transferring portion;

a plurality of second conveyance guide ribs, disposed between the transferring portion and the image heating portion, configured to guide the sheet conveyed upward from the sheet containing portion toward the transferring portion;

an intake port, disposed below the sheet containing portion, configured to intake outside air into the image forming apparatus; and a fan, disposed above the image heating portion and configured to exhaust the air guided by the first conveyance guide ribs and the second conveyance guide ribs flowing from the intake port, out of the image forming apparatus.

2. The image forming apparatus according to claim 1, wherein the intake port is disposed on a bottom surface of the image forming apparatus.

3. The image forming apparatus according to claim 1, wherein the first conveyance guide ribs include a portion configured such that the closer to an upstream side in a guide direction thereof, the greater the airflow resistance of an air current generated by the first conveyance guide ribs.

4. The image forming apparatus according to claim 1, wherein the second conveyance guide ribs include a portion such that the closer to an upstream side in a guide direction thereof, the greater the airflow resistance of an air current generated by the second conveyance guide ribs.

5. The image forming apparatus according to claim 1, wherein each of the first conveyance guide ribs is configured such that an end thereof on the side of the transferring portion is oriented in a direction separating from a center of the transferring portion in a horizontal direction.

6. The image forming apparatus according to claim 1, wherein each of the second conveyance guide ribs is configured such that an end thereof on the side of the transferring portion is oriented in a direction separating from a center of the transferring portion in a horizontal direction.

7. The image forming apparatus according to claim 1, further comprising:

a document reading portion configured to read a document; and a link portion including the fan, wherein the fan exhausts the air to an intra-body space between the document reading portion and the image forming portion.

* * * * *